US011359345B2

(12) United States Patent
Downey et al.

(10) Patent No.: US 11,359,345 B2
(45) Date of Patent: Jun. 14, 2022

(54) SEDIMENT CONTROL SYSTEM

(71) Applicant: Hercules Eco, LLC, Denver, CO (US)

(72) Inventors: Josh Downey, Denver, CO (US); Jeff Hatton, Denver, CO (US); Jake Foster, Parker, CO (US)

(73) Assignee: Hercules Eco, LLC, Denver, CO (US)

( * ) Notice: Subject to any disclaimer, the term of this patent is extended or adjusted under 35 U.S.C. 154(b) by 0 days.

(21) Appl. No.: 17/229,472

(22) Filed: Apr. 13, 2021

(65) Prior Publication Data

US 2021/0348357 A1 Nov. 11, 2021

Related U.S. Application Data

(60) Provisional application No. 62/704,380, filed on May 7, 2020.

(51) Int. Cl.
*E02D 17/20* (2006.01)
*E01C 11/22* (2006.01)
*E02B 3/04* (2006.01)

(52) U.S. Cl.
CPC ..... *E02D 17/205* (2013.01)

(58) Field of Classification Search
CPC ... E02D 17/205; E02D 17/202; E02D 29/025; E02D 29/0266; E02B 3/04; E02B 3/14; A01G 9/28
See application file for complete search history.

(56) References Cited

U.S. PATENT DOCUMENTS 5,119,587 A * 6/1992 Waltz ..... A01G 9/28 47/33
5,615,529 A * 4/1997 Johnson ..... A01G 9/28 52/604

(Continued)

FOREIGN PATENT DOCUMENTS

DE 3331563 C2 * 10/1994 ..... E02B 3/04
DE 102012020827 A1 * 4/2014 ..... B61D 1/06

(Continued)

*Primary Examiner* — Frederick L Lagman
*Assistant Examiner* — Stacy N Lawson
(74) *Attorney, Agent, or Firm* — Hall Estill Law Firm

(57) ABSTRACT

A sediment control system including a first barrier element. The first barrier element has a first end, a second end, a front side, a back side, a bottom side and a top side. The sediment control system also having a second barrier element. The second barrier element has a first end, a second end, a front side, a back side, a bottom side and a top side. The first end of the first barrier element cooperating with the first end of the second barrier element to prevent the separation of the first and second barrier elements. A barrier includes a first end and a second end wherein the second end is disposed a certain length from the first end. The barrier element also has a front side and a back side wherein the back side is disposed a total depth from the front side. The barrier element further includes a bottom side and a top side wherein the top side is disposed a certain height from the bottom side. The barrier element has a generally triangular cross-sectional shape perpendicular to the length of the barrier element. A method of controlling soil from a disturbed area from being transported to undesired locations using the sediment control system.

13 Claims, 5 Drawing Sheets

(56) References Cited

U.S. PATENT DOCUMENTS

| | | | | |
|---|---|---|---|---|
| 6,449,897 | B1 * | 9/2002 | Gaston | A01G 9/28 47/33 |
| 7,029,200 | B1 * | 4/2006 | Cravens | E02B 3/04 405/111 |
| 7,762,746 | B2 * | 7/2010 | Berenyi | E01F 7/025 405/302.7 |
| 8,407,948 | B1 * | 4/2013 | Nash | E02D 27/00 52/102 |
| 9,080,298 | B2 * | 7/2015 | Yu | E02B 3/14 |
| 2002/0112415 | A1 * | 8/2002 | Eakin | A01G 9/28 52/102 |
| 2007/0294844 | A1 * | 12/2007 | Gunnarson | E04G 21/30 14/69.5 |
| 2013/0298481 | A1 * | 11/2013 | Perotti | E04B 2/08 52/102 |
| 2015/0354213 | A1 * | 12/2015 | Burnquist | E04C 1/39 52/604 |
| 2017/0191286 | A1 * | 7/2017 | Rudolph | E04H 17/063 |
| 2018/0106036 | A1 * | 4/2018 | Fryfogle | E04C 1/395 |
| 2020/0217021 | A1 * | 7/2020 | Divine | E01C 11/222 |

FOREIGN PATENT DOCUMENTS

| | | | | |
|---|---|---|---|---|
| EP | 0178510 | A2 * | 4/1986 | E02B 3/04 |
| GB | 2108183 | A * | 5/1983 | E01C 13/00 |
| WO | WO-2020064321 | A1 * | 4/2020 | E02D 17/205 |

* cited by examiner

SEDIMENT CONTROL SYSTEM

CROSS-REFERENCE TO RELATED APPLICATIONS

The present application is a conversion of U.S. Provisional Application having U.S. Ser. No. 62/704,380, filed May 7, 2020, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a sediment control system that can be implemented to limit the amount of soil washed from construction sites.

2. Description of the Related Art

During construction of various structures, natural erosion preventers, such as grass and plants, are destroyed, or removed, allowing for soil to be washed away by stormwater. Sediment barriers can be used to capture eroded soil and prevent the soil from being washed away, but a lot of the sediment barriers have problems. Some barriers can be washed away because they are not securely in place or properly installed. Some barriers can be separated from other barriers, which allows for soil to be carried away in the stormwater and most commonly sediment barriers can be easily damaged on a construction site rendering them inadequate to function as designed.

Accordingly, there is a need for a sediment control system that can withstand the forces applied to them and reduce, to the maximum extend possible, soil from being discharged from construction sites by stormwater.

SUMMARY OF THE DISCLOSURE

The present disclosure is directed toward a sediment control system. The sediment control system including a first barrier element. The first barrier element has a first end, a second end, a front side, a back side, a bottom side and a top side. The sediment control system also having a second barrier element. The second barrier element has a first end, a second end, a front side, a back side, a bottom side and a top side. The first end of the first barrier element cooperating with the first end of the second barrier element to prevent the separation of the first and second barrier elements.

The present disclosure is also directed toward a barrier element. The barrier element includes a first end and a second end wherein the second end is disposed a certain length from the first end. The barrier element also has a front side and a back side wherein the back side is disposed a total depth from the front side. The barrier element further includes a bottom side and a top side wherein the top side is disposed a certain height from the bottom side. The barrier element has a generally triangular cross-sectional shape perpendicular to the length of the barrier element.

Furthermore, the present disclosure is directed toward a method of controlling soil from a disturbed area from being transported to undesired locations. The method includes adjoining a first barrier element and a second barrier element to create a sediment control system. The method also includes positioning the sediment control system at a desired location.

DETAILED DESCRIPTION OF THE DISCLOSURE

Figure 1:
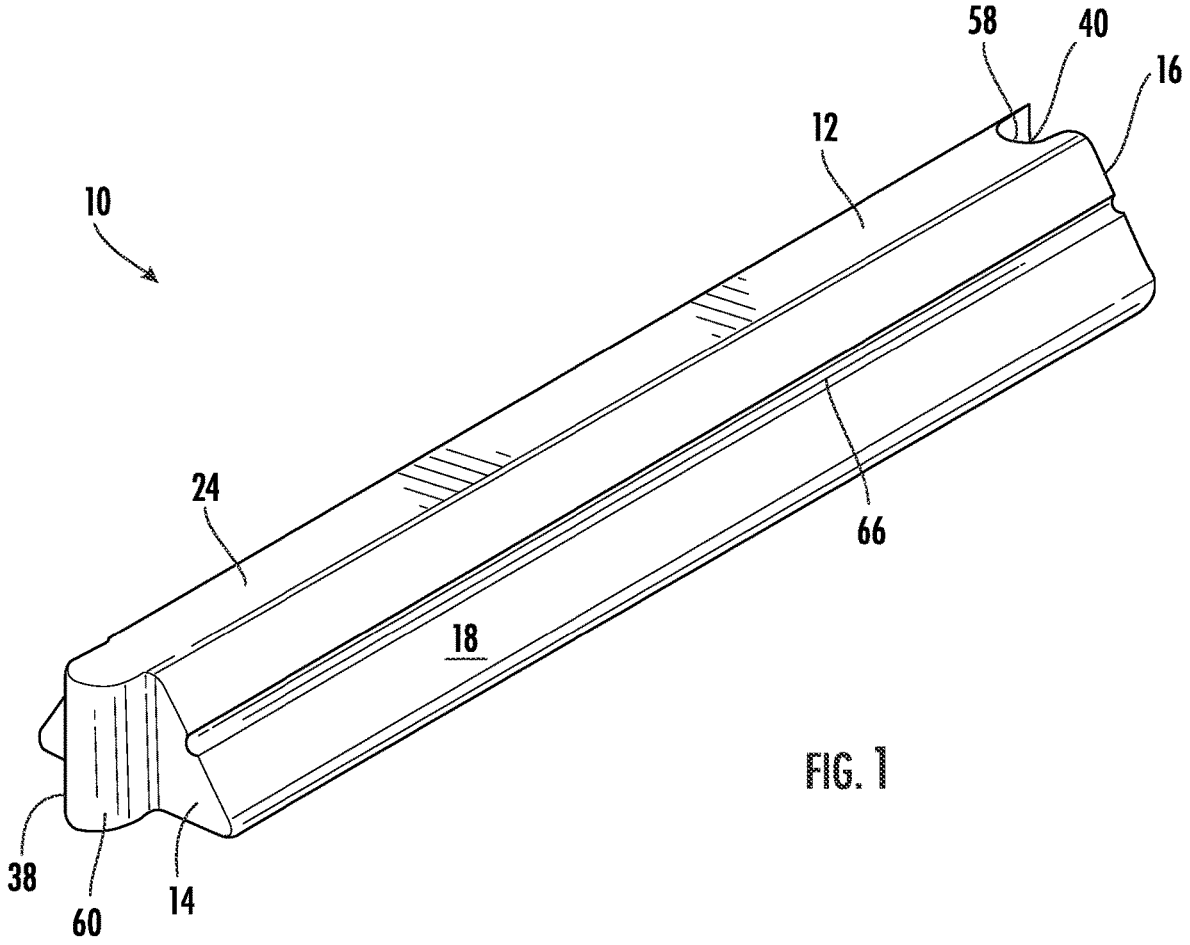
FIG. 1 is a perspective view of a barrier element of a sediment control system constructed in accordance with the present disclosure.

The present disclosure relates to a sediment control system 10 to reduce soil from being uncontrollably discharged to undesired locations. More specifically, the sediment control system 10 is used to reduce, to the maximum extent practicable, soil from a disturbed area, such as a construction site, from being transported to undesired locations via stormwater runoff. Referring now the drawings, and more specifically to FIG. 1, the sediment control system 10 includes at least one barrier element 12 that can be positioned at various locations around a disturbed area to prevent sheet flow runoff of soil from the disturbed area or as a velocity dissipation device. In certain embodiments, multiple barrier elements 12 are linked together to create the sediment control system 10. The barrier elements 12 can be configured to be set on the ground, on sidewalks or curbs that border the disturbed area, or a combination thereof.

Each barrier element 12 has a length, a depth and a height. The length extends from a first end 14 of the barrier element 12 to a second end 16 of the barrier element 12. The depth extends from a front side 18 of the barrier element 12 to a back side 20 of the barrier element 12. The height of the barrier element 12 extends from a bottom side 22 of the barrier element 12 to a top side 24 of the barrier element 12.

Figure 2A:
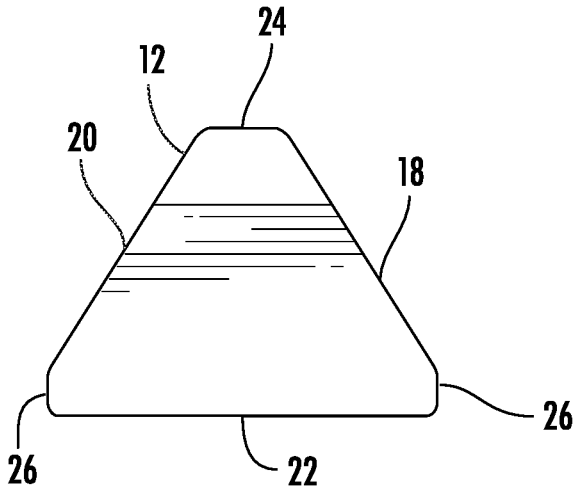
FIGS. 2A-2C are cross-sectional views of the barrier element of the sediment control system shown in FIG. 1 constructed in accordance with the present disclosure.
Figure 2B:
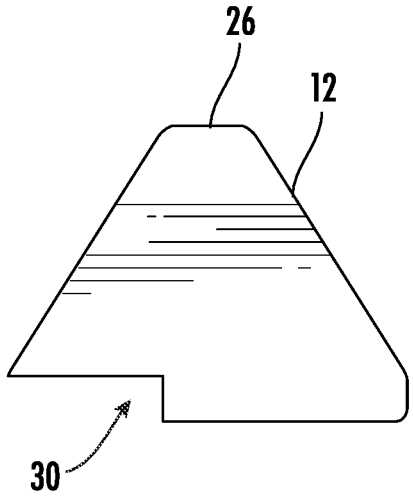
Figure 2C:
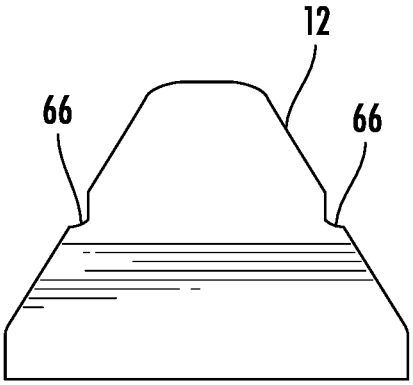

Referring now to FIGS. 2A-2C, the barrier elements 12 can have any cross-sectional shape perpendicular to the length of the barrier element 12 such that the barrier elements 12 can perform as described herein. In one embodiment, the cross-sectional shape of the barrier element 12 perpendicular to the length of the barrier element 12 is substantially triangular. In another embodiment of the present disclosure, the cross-sectional shape of the barrier element 12 perpendicular to the length of the barrier element 12 is substantially triangular with squared-off points 26.

In a further embodiment of the present disclosure, each barrier element 12 can have a vertical hole(s) 28 (or substantially vertical hole) disposed from the top side 24 of the barrier element 12 down through the bottom side 22 of the barrier element 12 for receiving a securing device (not shown) that can engage with the ground to secure the barrier element 12 to the ground. The securing device can be any device known in the art capable of extending through the vertical holes in the barrier element 12 and engaging the barrier element 12 and the ground to secure the barrier element 12 to the ground. For example, the securing device can be a large nail, spike, or screw. Each barrier element 12 may also be secured, without an anchor, by being linked together with other barrier elements 12.

In another embodiment, the barrier elements 12 are configured to sit atop a combination of the ground and a curb or sidewalk that borders the disturbed area. In this embodiment, the bottom side of the barrier element 12 can include a notched portion 30 that engages with the curb or sidewalk. The notched portion 30 can be any portion of the depth of the bottom side 22 of the barrier element 12. In one embodiment, the depth of the notched portion 30 can be greater than half of the depth of the barrier element 12. In another embodiment, the depth of the notched portion 30 can be less than half of the depth of the barrier element 12. In a further embodiment, the notched portion 30 can be half of the depth of the barrier element 12. The depth of the notched portion 30 is greater than 25% of the depth of the depth of the barrier element 12. In another embodiment, the depth of the notched portion 30 is greater than 75% of the depth of the depth of the barrier element 12. In another embodiment of the present disclosure, the depth of the notched portion 30 is greater than 85% of the depth of the depth of the barrier element 12.

Figure 3A:
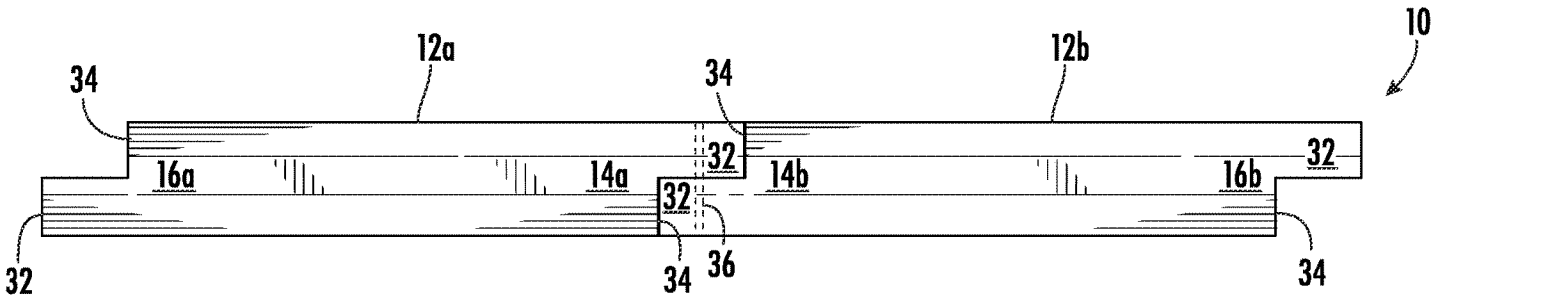
FIGS. 3A-3C are top plan views of various embodiments of the barrier element of the sediment control system constructed in accordance with the present disclosure.
Figure 3B:
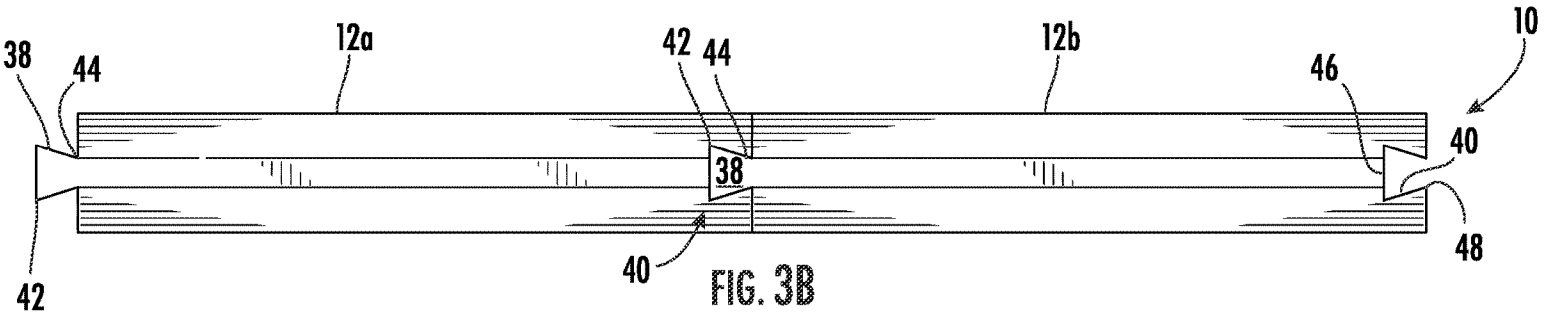
Figure 3C:
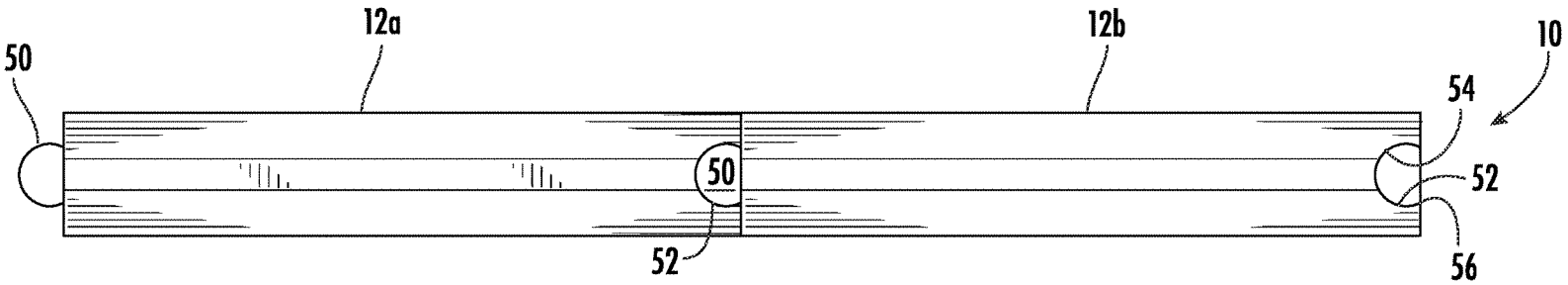

Referring now to FIGS. 3A-3C, the ends 14, 16 of the barrier elements 12 can have various designs to permit multiple barrier elements 12 to cooperate with each other in the sediment control system 10. In one embodiment, the ends 14,16 of the barrier elements 12 can be dog-legged (or L-end) such that one side 32 of the end 14,16 extends further than the other side 34 of the end 14,16 to create an extended side 32 and a short side 34. The short side 34 of a first end 14 of a barrier element 12 will be in alignment with the extended side 32 of a second end 16 of the barrier element 12 and the extended side 32 of the first end 14 will be aligned with the short side 34 of the second end 16 of the barrier element 12. In this embodiment, the extended side 32 of a first end 14*a* of a first barrier element 12*a* can be positioned directly adjacent to the short side 34 of a first end 14*b* of a second barrier element 12*b*. Furthermore, the short side 34 of the first end 14*a* of the first barrier element 12*a* can be positioned directly adjacent to the extended side 32 of the first end 14*b* of the second barrier element 12*b*. Multiple barrier elements 12 for this embodiment can be laid out to work with each other in the manner described above to create the sediment control system 10.

In a further embodiment of the present disclosure, the extended sides 32 of the ends 14,16 of adjacent barrier elements 12 can extend far enough that the extended sides 32 can have horizontally disposed openings 36 that are generally in alignment disposed therein for receiving a pin element, such as cotter pin, to secure the extended sides 32 of the first and second barrier elements 12 together. This pin connection can be done between multiple barrier elements 12 to form any desired length of barrier elements 12 for the sediment control system 10.

In yet another embodiment, the ends 14,16 of adjacent barriers 12 can be angled. For example, the first end 14*a* of a first barrier element 12*a* can be angled from front to back and the first end 14*b* of a second barrier 12*b* can have an angle that mirrors the angle of the first end 14*a* of the first barrier 12*a*. The angle of the barriers 12*a* and 12*b* in this embodiment can be any desired angle such that the ends work together to keep the barrier elements 12 in their desired position to accomplish the described goals for the sediment control system 10.

In another embodiment of the present disclosure, the ends 14,16 of adjacent barrier elements 12 can be coupled together with a tongue and groove connection. Thus, the first end 14*a* of a first barrier element 12*a* can have a protrusion 38 that extends from the first end 14*a* and a first end 14*b* of a second barrier element 12*b* disposed adjacently can have a cavity 40 disposed therein for receiving the protrusion 38 of the first end 14*a* of the first barrier element 12*a*. The second end 16*a* of the first barrier element 12*a* can have a protrusion 38 or a cavity 40 and the second end 16*b* of the second barrier element 12*b* can have a protrusion 38 or a cavity 40. Thus, the ends of a barrier element 12 can have any combination of a cavity or a protrusion so that multiple barrier elements 12 can be linked together. In this embodiment, the protrusion 38 can be any shape and size desirable, and the cavity 40 can be any shape and size such that the protrusion 38 can fit inside the cavity 40.

In a further embodiment of the present disclosure, the protrusion 38 can extend vertically along the entire height of the barrier element 12. Similarly, the cavity 40 would have to extend vertically in the end of the barrier element 12 to be able to receive the protrusion 38. In this embodiment, the protrusion 38 can have a unique cross-sectional shape when looking from the top down. The cross-sectional shape can be triangular, C- or wedge-shaped wherein the protrusion 38 has a wider portion 42 and a narrower portion 44. The narrower portion 44 of the protrusion 38 is positioned closer to a first barrier element 12*a* the protrusion 38 extends from. The wider portion 42 of the protrusion 38 is positioned further from the first barrier element 12 the protrusion 38 extends from. A second barrier element 12*b* can have the cavity 40 disposed therein that is sized to receive the triangular-shaped protrusion. Thus, in this embodiment, the cavity 40 is triangular- or wedge-shaped as well. Similar to the protrusion 38, the cavity 40 can have a wide side 46 and a narrow side 48. The wide side 46 of the cavity 40 is sized such that the wider portion 46 of the protrusion 38 can fit inside and the narrow side 48 of the cavity 40 is sized so that the narrower portion 44 of the protrusion 38 can fit inside. The narrow side 48 of the cavity 40 is positioned at the end 14*b*,16*b* of the second barrier element 12*b* and the wide side 46 of the cavity 40 is positioned back inside the second barrier element 12. The orientation of the protrusion 38 and the cavity 40 of this embodiment makes it such that the first and second barrier elements 12*a*,12*b* can only be joined by sliding the protrusion 38 of the first barrier element 12*a* vertically up or down in the cavity 40 of the second barrier element 12*b*.

In another embodiment, the protrusion 40 can have another unique cross-sectional shape when looking from the top down. The cross-sectional shape for this embodiment can be circular, or substantially circular. Substantially circular includes, but is not limited to, circular shapes that are smaller than a full circle and larger than a semi-circle. The circular protrusion 40 can extend from the first end 14*a* of a first barrier element 12*a* and fit inside a circular cavity 52 disposed in the first end 14*b* of a second barrier element 12*b* to secure the first barrier element 12*a* to the second barrier element 12*b*. Similar to the embodiment above, the first and second barrier elements 12*a*,12*b* can only be joined by sliding the protrusion 50 of the first barrier element 12*a* vertically up or down in the cavity 52 of the second barrier element 12*b*. In a further embodiment, the protrusion 40 can be essentially a full circle portion 54 with a neck portion 56 extending therefrom that connects the full circle portion 54 to the first end 14*a* of the first barrier element 12*a* and the corresponding cavity 40 disposed in the second barrier element 12*b* could be shaped such that it receives the full circle portion 54 and the neck portion 56 of the protrusion 38.

It should be understood and appreciated that the protrusion 38 and cavity 40 can be any shape and size such that a first and second barrier element 12*a*/12*b* can be secured together and cannot be separated by pulling the barrier elements 12 in a lateral direction. Examples of cross-sectional shapes of the protrusion 38 can include oval, oblong, conical, and the like.

Figure 4A:
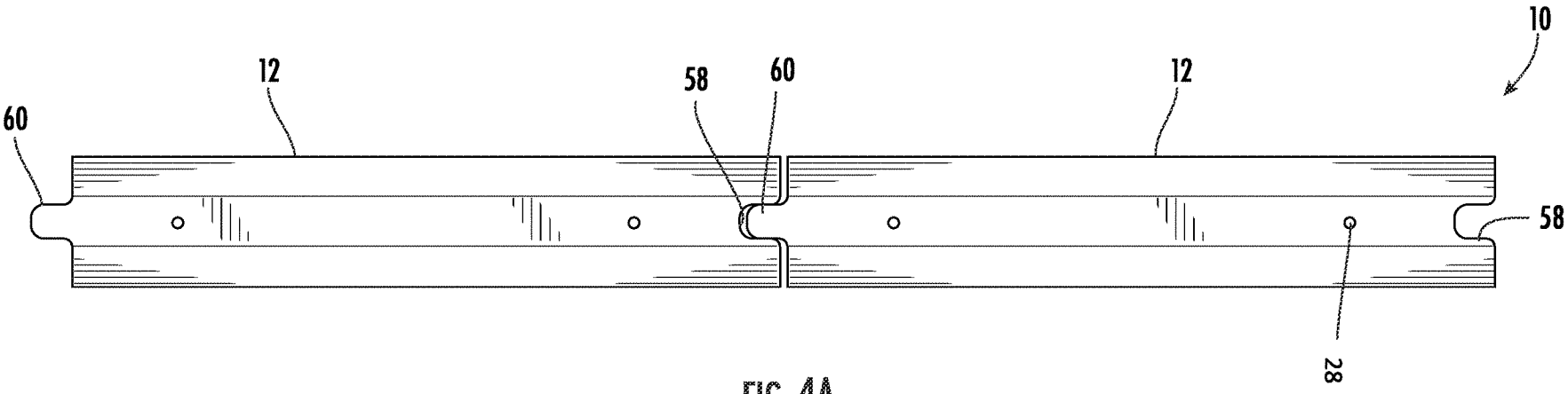
FIGS. 4A-4C are top plan views of various portions of another embodiment of the barrier element of the sediment control system constructed in accordance with the present disclosure.
Figure 4C:
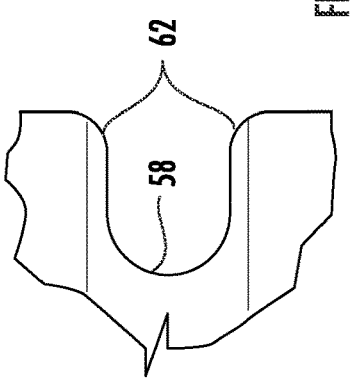
Figure 4B:
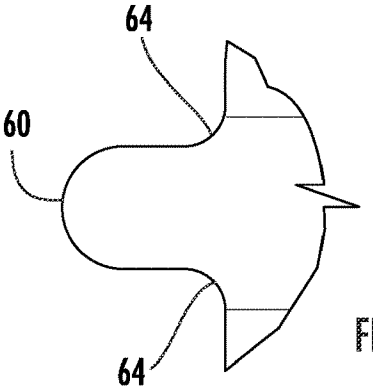

In yet another embodiment of the present disclosure shown in FIGS. 4A-4C, the cavity 40 can be a u-shaped cavity 58 and the protrusion 38 can be an n-shaped protrusion 60 to fit inside the u-shaped cavity 58. This cavity 58 and protrusion 60 shaped like this permits some movement, laterally and rotationally, of the adjacently disposed barrier elements 12*a*,12*b* relative to each other. This orientation allows the barrier elements 12*a*,12*b* to be matingly engaged in a lateral direction (horizontally) and does not require the n-shaped protrusion 60 or u-shaped cavity 58 of one barrier element 12 to have to be vertically engaged with each other. The u-shaped cavity 58 can have transition areas 62 where the u-shaped cavity 58 transitions to the first end 14 or second end 16 of the barrier element 12. The transition areas 62 are curved to facilitate the rotational movement between adjacently disposed barrier elements 12 when forces are applied to the barrier elements 12 at the disturbed area. Similarly, the n-shaped protrusion 60 can have transition areas 64 where the n-shaped protrusion 60 transitions to the first end 14 or second end 16 of the barrier element 12. The transition areas 64 adjacent to the n-shaped protrusion 60 are curved like the transition areas 62 adjacent to the u-shaped cavity 58 to facilitate the rotational movement between adjacently disposed barrier elements 12 when forces are applied to the barrier elements 12 at the disturbed area.

Figure 5A:
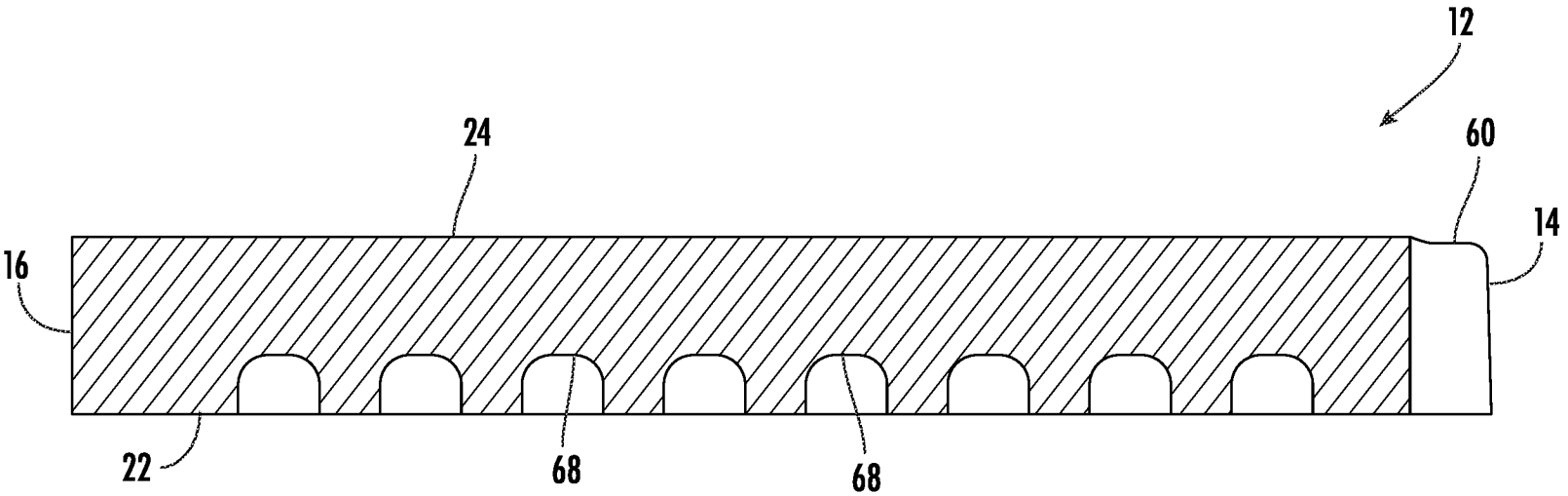
FIGS. 5A-5B are a cross-sectional view and a bottom plan view of another embodiment of the barrier element of the sediment control system constructed in accordance with the present disclosure.
Figure 5B:
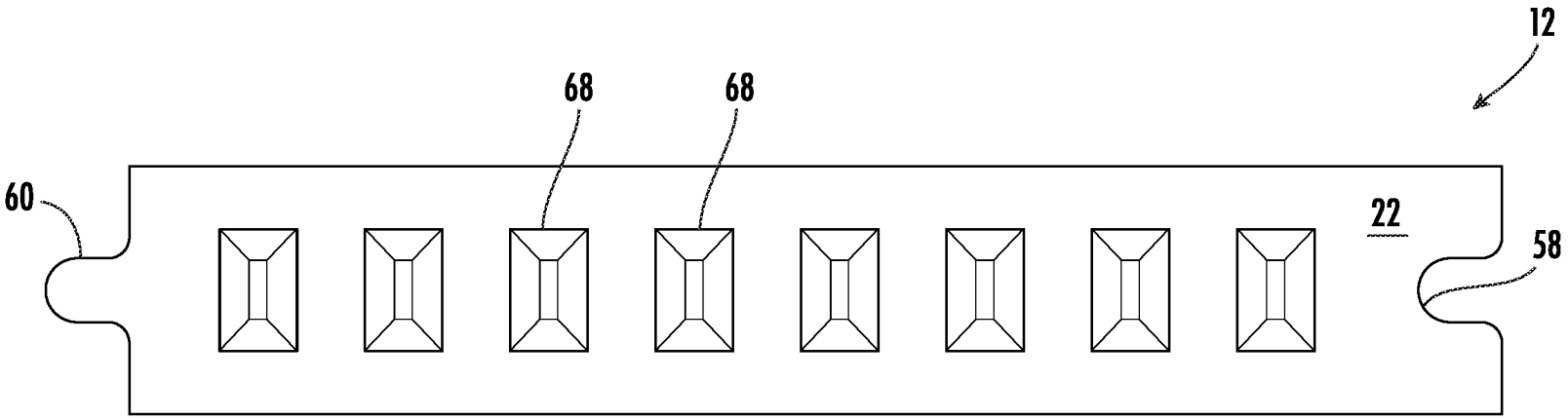

In another embodiment, the front side 18 and/or the back side 20 can have a channel 66 running the length or a partial length of the barrier elements 12. The channel 66 can be disposed on the barrier elements 12 to provide a gripping point for vehicle tires that will drive over the barrier elements 12 to get to a construction site (disturbed area). Referring now to FIGS. 5A-5B, the bottom side 22 of the barrier elements 12 can have a plurality voids 68 disposed therein to lower the weight of the barrier elements 12 to make them easier to move and carry, but does not limit the strength needed of the barrier elements 12. The voids 68 can have any shape such that the structural integrity of the barrier elements 12 are not compromised. For example, the voids 68 can have a domed shape, a rounded pyramid shape, a square shape, a rectangular shape, etc.

The barrier elements 12 can be constructed of any material known in the art capable of handling the operational and structural requirements of the barrier elements 12. The barrier elements 12 can be constructed of a rubber containing composition and have a specific density that provides the barrier elements 12 desirable structural qualities. In one embodiment of the present disclosure, the rubber containing composition can be a mixture of crumb rubber and binder. Regarding density of the barrier elements, the density of the barrier elements 12 can be such that the barrier elements 12 prevent fluids or materials that may be suspended in fluids from flowing through the barrier elements 12 and allows the barrier elements 12 to withstand the rigors of a construction site, but not make the barrier elements 12 so dense that movement of the barrier elements 12 by individuals is prohibitive. In one embodiment, the density of the barrier elements 12 is in a range of from about 0.0365 pounds/cubic inch to about 0.0385 pounds/cubic inch. In another embodiment, the density of the barrier elements 12 is in a range of from about 0.0365 pounds/cubic inch to about 0.0375 pounds/cubic inch. In a further embodiment, the density of the barrier elements 12 is in a range of from about 0.0375 pounds/cubic inch to about 0.0385 pounds/cubic inch. In yet another embodiment, the density of the barrier elements 12 is in a range of from about 0.0370 pounds/cubic inch to about 0.0380 pounds/cubic inch.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A sediment control system, the system comprising:

a first barrier element having a first end, a second end, a front side, a back side, a bottom side and a top side, the front side having a first angled portion that extends from a front vertical side portion to the top side, the back side having a second angled portion that extends from a back vertical side portion to the top side, the first barrier element having a length from the first end to the second end and a total horizontal depth from the front vertical side portion to the back vertical side portion of the first barrier element, and the top side free of any channels;

only one channel disposed in the first angled portion or the second angled portion;

a second barrier element having a first end, a second end, a front side, a back side, a bottom side and a top side, the first end of the first barrier element including a protrusion that matingly engages with a cavity disposed in the first end of the second barrier element to prevent the separation of the first and second barrier elements, the protrusion and cavity extending along an entire height of the first and second barrier elements to prevent soil from being uncontrollably discharged to undesired locations, the front side of the second barrier element having a first angled portion that extends from a front vertical side portion to the top side of the second barrier element, the back side of the second barrier element having a second angled portion that extends from a back vertical side portion to the top side of the second barrier element, the second barrier element having a length from the first end to the second end of the second barrier element and a total horizontal depth from the front vertical side portion to the back vertical side portion of the second barrier element, and the top side of the second barrier element free of any channels;

only one channel disposed in the first angled portion of the second barrier or the second angled portion of the second barrier;

a first notched portion in a lower corner of the first barrier element to engage a curb or sidewalk, the first notched portion having a horizontal depth from the front side or back side of the first barrier element that is greater than 50% of the total horizontal depth of the first barrier element, the first notched portion disposed along a majority of the length of the first barrier element; and a second notched portion in a lower corner of the second barrier element to engage a curb or sidewalk, the second notched portion having a horizontal depth from the front side or back side that is greater than 50% of the total horizontal depth of the second barrier element, the second notched portion disposed along a majority of the length of the second barrier element.

2. The system of claim 1 wherein the protrusion is n-shaped and the cavity is u-shaped to allow for some rotational and lateral movement of the first and second barrier elements relative to each other.

3. The system of claim 1 wherein the horizontal depth of the first notched portion and the horizontal depth of the second notched portion is less than 75% of the total horizontal depth of the first barrier element and the total horizontal depth of the second barrier element, respectively.

4. The system of claim 1 wherein the first or second barrier element has a specific density and the density is in a range from about 0.0365 pounds/cubic inch to about 0.0385 pounds/cubic inch.

5. The system of claim 1 wherein the bottom side of the first or second barrier element includes a plurality of voids disposed therein, wherein the voids are dome shaped or a rounded pyramid shape.

6. A barrier element, the barrier element comprising:

a first end;

a second end, the second end disposed a certain length from the first end;

a front side;

a back side;

a bottom side;

a top side, the front side having a first angled portion that extends from a front vertical side portion to the top side, the back side having a second angled portion that extends from a back vertical side portion to the top side, the back vertical side portion disposed a total horizontal depth from the front vertical side portion, and the top side free of any channels;

only one channel disposed in the first angled portion or the second angled portion; and a notched portion in a lower corner of the barrier element to engage a curb or sidewalk, the notched portion having a horizontal depth from the front side or back side of the barrier element that is greater than 50% of the total horizontal depth of the barrier element, the notched portion disposed along a majority of the length of the barrier element;

wherein the barrier element is configured to matingly engage with an identical barrier element to form a sediment control system that prevents soil from being uncontrollably discharged to undesired locations.

7. The barrier element of claim 6 wherein the bottom side of the barrier element includes a plurality of voids disposed therein, wherein the voids are dome shaped or a rounded pyramid shape.

8. The barrier element of claim 6 wherein the barrier element has a specific density and the density is in a range from about 0.0365 pounds/cubic inch to about 0.0385 pounds/cubic inch.

9. A method of controlling soil from a disturbed area from being transported to undesired locations, the method comprising:

adjoining a first barrier element and a second barrier element to create a sediment control system, the sediment control system includes:

the first barrier element having a first end, a second end, a front side, a back side, a bottom side and a top side, the front side having a first angled portion that extends from a front vertical side portion to the top side, the back side having a second angled portion that extends from a back vertical side portion to the top side, the first barrier element having a length from the first end to the second end and a total horizontal depth from the front vertical side portion to the back vertical side portion of the first barrier element, and the top side free of any channels;

the second barrier element having a first end, a second end, a front side, a back side, a bottom side and a top side, the first end of the first barrier element including a protrusion that matingly engages with a cavity disposed in the first end of the second barrier element to prevent the separation of the first and second barrier elements, the protrusion and cavity extending along an entire height of the first and second barrier elements to prevent soil from being uncontrollably discharged to undesired locations, the front side of the second barrier element having a first angled portion that extends from a front vertical side portion to the top side of the second barrier element, the back side of the second barrier element having a second angled portion that extends from a back vertical side portion to the top side of the second barrier element, the second barrier element having a length from the first end to the second end of the second barrier element and a total horizontal depth from the front vertical side portion to the back vertical side portion of the second barrier element, and the top side of the second barrier element free of any channels;

a first notched portion in a lower corner of the first barrier element to engage a curb or sidewalk, the first notched portion having a horizontal depth from the front side or back side of the first barrier element that is greater than 50% of the total horizontal depth of the first barrier element, the first notched portion disposed along a majority of the length of the first barrier element; and a second notched portion in a lower corner of the second barrier element to engage a curb or sidewalk, the second notched portion having a horizontal depth from the front side or back side that is greater than 50% of the total horizontal depth of the second barrier element, the second notched portion disposed along a majority of the length of the second barrier element; and positioning the sediment control system at a desired location.

10. The method of claim 9 wherein the protrusion is n-shaped and the cavity is u-shaped to allow for some rotational and lateral movement of the first and second barrier elements relative to each other.

11. The method of claim 9 wherein the horizontal depth of the first notched portion and the horizontal depth of the second notched portion is less than 75% of the total horizontal depth of the first barrier element and the total horizontal depth of the second barrier element, respectively.

12. The method of claim 9 wherein the first or second barrier element has a specific density and the density is in a range from about 0.0365 pounds/cubic inch to about 0.0385 pounds/cubic inch.

13. The method of claim 9 wherein the bottom side of the first or second barrier element includes a plurality of voids disposed therein, wherein the voids are dome shaped or a rounded pyramid shape.

* * * * *